United States Patent [19]

Border

[11] Patent Number: 4,848,091

[45] Date of Patent: Jul. 18, 1989

[54] REFRIGERATED TABLE-BAR

[75] Inventor: Solly Border, San Mateo, Calif.

[73] Assignee: Instabar Corporation, Chester, N.Y.

[21] Appl. No.: 144,185

[22] Filed: Jan. 15, 1988

[51] Int. Cl.[4] ..... F25B 21/02

[52] U.S. Cl. ..... 62/3.2; 62/258; 62/458

[58] Field of Search ..... 62/258, 458, 3

[56] References Cited

U.S. PATENT DOCUMENTS 2,093,856 9/1937 Wales ..... 62/258
2,895,311 7/1959 Spalvins ..... 62/458 X
4,400,951 8/1983 Cherry ..... 62/258
4,704,870 11/1987 Beitner ..... 62/258

*Primary Examiner*—Lloyd L. King
*Attorney, Agent, or Firm*—T. R. Zegree

[57] ABSTRACT

A portable refrigerated table-bar useful in the hospitality industry comprises an upright cylindrical cabinet having a table top, a centrally disposed dual tube arrangement for raising or lowering slidingly a pair of trays affixed thereto in spaced apart relation and a thermoelectric refrigerating unit disposed within the lower portion of the cabinet. The sliding movement of the trays is activated by electromechanical means associated therewith. One tray is provided with a plurality of depressions for accomodation of beverage bottles.

13 Claims, 5 Drawing Sheets

REFRIGERATED TABLE-BAR

BACKGROUND OF THE INVENTION

This invention relates to an improved portable refrigerated table-bar. More particularly, the invention relates to a table-bar, the construction of which is adapted for storage of beverages and food items under refrigeration and easy access thereto when desired.

While certain types of refrigerated cabinets and small size refrigerators are known, the device of this invention provides a new approach to the structural form of a table-bar combination which offers some advantages over devices of the known type.

OBJECTS OF THE INVENTION

It is the main object of this invention to provide a table-bar in the form of a combined piece of furniture and of cold bar which can be placed in a small place particularly in hotel rooms.

Another object of the invention is to provide a convenient table-bar having a unique type of refrigeration, which is simple and economical, which can be accomodated in any area of a room and which can keep beverages at a low temperature between about 38° and 44° F. (about 3°–7° C.).

A further object of the invention is to provide a table-bar comprising electromechanical means enabling to convert a table into a bar merely by a simple turn of a key and to revert the open bar back to the table form by pushing down the top of the table until it locks in its closed position.

Still another object of the invention is the provision of a table-bar of the character described herein which can be manufactured at a relatively low cost from readily available materials.

BRIEF SUMMARY OF THE INVENTION

Thease and other objects of the invention will become more fully apparent from the following description taken in conjunction with the accompanying drawings.

In accordance with the present invention, there is provided a refrigerated table-bar comprising, in combination, an upright cabinet having a base structure and a refrigerated chamber enclosed in a cylindrical body. A transverse partition separates the bottom structure from the chamber and a round table top provides a cover for the top portion of the device. A thermoelectric refrigerating unit is disposed in the base structure and a central upright actuating mechanism imparting vertical motion, including a tube means, is positioned between the upper end of the base structure and underside of the table top wall, the tube means comprising an outer tube, an inner tube and a gas spring located within the inner tube. A lower tray is affixed transversely to lower portion of the tube means and comprises a plurality of concave depressions adapted for placing beverage bottles or cans therein. An upper tray is affixed to upper portion of the tube means in parallel relation to the lower tray and is supported by a plate secured to the tube means, said upper and lower trays being disposed inside said chamber and adapted for upward and downward movement. An electromechanical means is provided to activate the outer tube for sliding movement.

BRIEF DESCRIPTION OF THE DRAWINGS

In the accompanying drawings, wherein like reference characters designate corresponding elements throughout the view thereof.

DETAILED DESCRIPTION OF THE INVENTION

Figure 1:
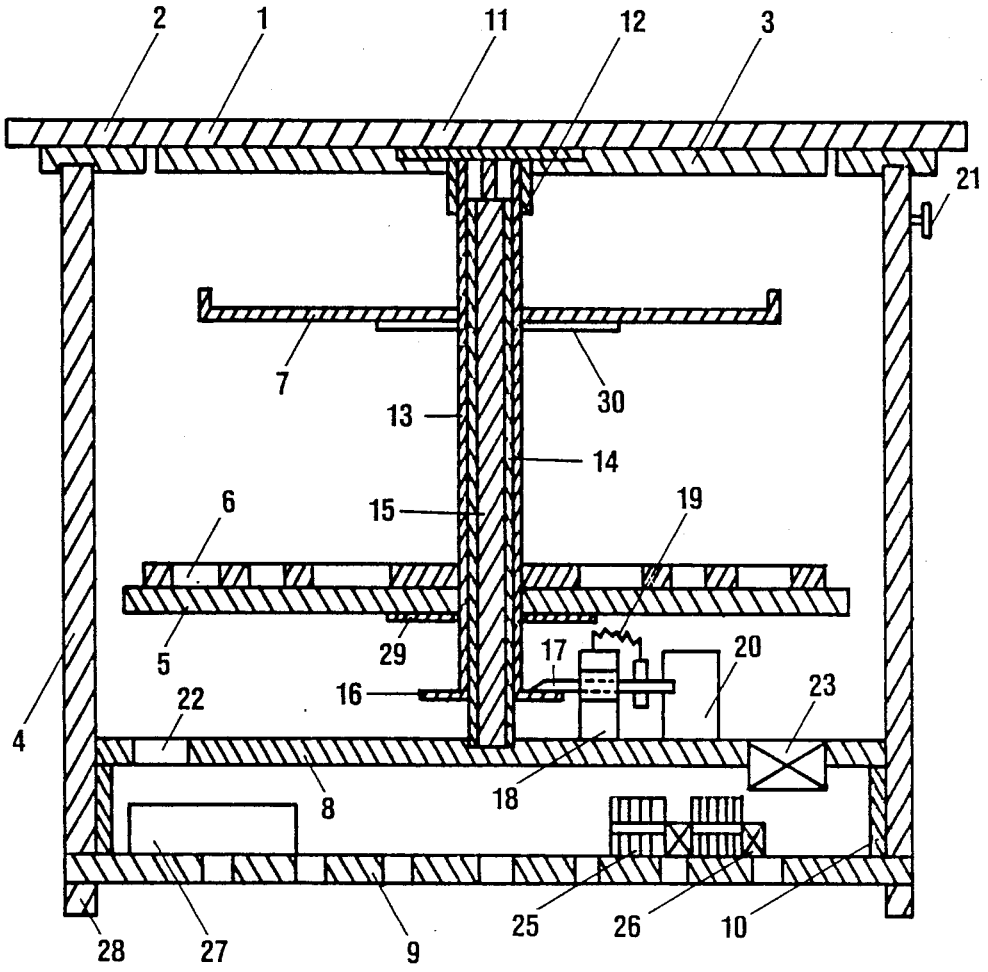
FIG. 1 is a sectional front view of the table-bar of the invention in its closed position.

Referring now to the drawings, the refrigerated table-bar of this invention, named "INSTABAR" table, comprises table top 1, circular frame 2 attached under table top 1, top insulation 3, cylindrical body 4 closed throughout its circumference and supported by legs 28, the body 4 being made preferably from cardboard recovered with a high-pressure laminated or glued venner. A plastic cylindrical member is located inside body 4 leaving a spacing of about ¾ inch between their respective walls, such spacing being filled with polyurethane foam insulation. A base structure is disposed transversely in the lower part of body 4 and is separated from the upper part of body 4 by transverse partition 8, thereby forming a compartment between the partition 8 and bottom wall 9 parallel thereto. Supports 10 extending between partition 8 and bottom 9 hold the assembly together.

A refrigerating unit disposed in the base structure comprises two thermoelectric modules 25 covered with a plurality of fins and connected electrically in parallel to a 12 volt, 9 amperes DC-regulated power supply 24. The refrigeration unit which is connected to an AC source of energy is capable of reducing the temperature on top of the fins to about 30 F. (about −1 C.). Bottom portions of modules 25 produce hot air in the base structure which is expelled with the aid of a pair of fans 26 through a plurality of holes 27 provided in bottom wall 9. The cold air produced by the refrigeration unit is forced into the hollow chamber above partition 8 by means of fan 23 affixed to the partition.

A centrally positioned tube means extending between the upper end of the base structure and the underside of table top 1 comprises outer tube 13, inner tube 14 and a compressed gas-actuated vertical gas spring 15. A pair of spaced apart parallel trays are transversely affixed to tube means. Thus a lower tray 5 comprising a plurality of concave depressions 6 in its upper surface adapted for placing beverage bottles therein is affixed in the lower portion of the tube means, while upper tray 7 is affixed to upper portion of the tube means and supported by a round plate 30 secured by welding to the tube means underneath tray 7. As shown in FIG. 1, both trays 5 and 7 are disposed inside the hollow chamber and are adapted for upward and downward movement together with the sliding of the tube means.

The table bar according to the invention further comprises an electromechanical means defined as a moving mechanism to activate outer tube 13 in its vertical sliding movement by means of solenoid 20. A plunger 17 is attached to solenoid 20 and passes through its guide housing 18. The moving part of solenoid 20 is coupled to a spring 19 which is attached to plunger 17. Solenoid 20 is connected by electrical wiring to lock 21 positioned in the upper portion of cylindrical body 4. Upon pressing the gas spring 15 will reach the height equal to that of inner tube 14, while when depressed, the inner tube will move over a distance of about 13 inches (33 cm.). It will be noted that outer tube 13 is adapted for telescopic sliding movement over inner tube 14. A ring 16 is secured by welding to outer tube 13 slightly above the top of partition 8 and a short distance of about 3½ in. (9 cm.) above ring 16 of plate 29 is welded perpendicularly to outer tube 13 with lower tray 5 being affixed thereto. The basic lower tray 5 is provided with a cut-off tray 6 secured to upper surface thereof and having a plurality of concave depressions therein of different sizes to accomodate a number of beverage bottles, glasses and the like.

At a distance of about 8½ inches (21.6 cm.) above lower tray 6, plate 30 is affixed to outer tube 13 to support round upper tray 7 provided with a short vertical flange around its periphery.

Table top 1 which may be made out of various materials, such as plywood, particle board, lumber or marble is secured with set screws to top edge of outer tube 13 by plate 11 having a downwardly extending flange 12. A layer of polyurethane insulation 3 covered with a sheet of a plastic material is provided underneath table top 1.

In order to activate outer tube 13 for upward movement together with the trays secured thereto, key-operated lock 21 is turned on, whereby solenoid 20 will depress plunger 17 for a brief moment. Plunger 17 will then retreat for a short distance of about ⅜ inch (about 1 cm.) which is sufficient to free ring 16 and to depress gas spring 15 which will cause outer tube 13 and the two trays to move upwardly. The movement will continue until the ends of lower tray 5 will come into contact with frame 2 at which time the moving action stops and the bar arrangement is held stably in the open position extending above its original level, thereby providing ready access to refreshments placed on trays. To close the bar and convert the device back into a table form, table top 1 is manually pressed down to cause outer tube 13 to slide downwardly from its extended position until the table top 1 is locked automatically in its initial position when ring 16 passes over plunger 17 depressed by spring 16.

It will be apparent from the foregoing description that I have devised a doorless, completely enclosed and conveniently arranged table-bar for use in hotel rooms in particular enabling their occupants to have ready access to refreshments maintained at a low refrigerating temperature. The mechanism of the table-bar permits to hold the bar in a fixed and locked open position or to convert it easily to a round end table having a pleasing appearance of a furniture item. It is an important feature of my invention that a low temperature somewhat above the freezing point can be maintained within the closed refrigerated chamber while refreshments placed on trays are enclosed therein, thereby making them available for consumption in a fresh condition when the trays are raised to their extended position.

It will be understood that various modifications in the form or in the constructional details of my invention as herein described may be made without departing from the spirit thereof or the scope of the claims which follow.

I claim:

1. A refrigerated table-bar comprising, in combination:

an upright cabinet having a base structure, a refrigerated chamber enclosed in a cylindrical body and a round table top wall;

a thermoelectric refrigerating unit disposed in said base structure;

a central upright actuating mechanism imparting vertical motion including a tube means positioned between upper end of said base structure and underside of said table top wall, said tube means comprising an outer tube, an inner tube and a gas spring;

a lower tray affixed transversely to lower portion of said tube means comprising a plurality of concave depressions adapted for placing beverage bottles therein;

an upper tray affixed to upper portion of said tube means in parallel relation to said lower tray and supported by a plate secured to said tube means;

said lower and upper trays being disposed inside said chamber and adapted for upward and downward movement; and electromechanical means to activate said outer tube for said vertical motion.

2. A table-bar of claim 1 wherein said bottom structure comprises a top partition and a bottom wall of substantially the same size and spaced apart in parallel relationship.

3. A table-bar of claim 1 wherein said cylindrical body is closed throughout circumference thereof.

4. A table-bar of claim 1 wherein said table top wall is secured to top edge of said outer tube.

5. A table-bar of claim 1 wherein said refrigerating unit comprises a pair of thermoelectric modules for connection to power supply.

6. A table top of claim 5 wherein said modules are covered by a plurality of fins.

7. A table-bar of claim 2 wherein said bottom wall comprises a fan mounted thereon and a plurality of holes adapted to expel hot air generated by said power supply.

8. A table-bar of claim 2 wherein said refrigerating unit comprises a second fan affixed to said partition for forcing cold air into said refrigerated chamber.

9. A table-bar of claim 1 wherein said lower tray is movable upwardly substantially to the level of upper edge of said cylindrical body.

10. A table-bar of claim 1 wherein said electromechanical means includes a solenoid and a plunger connected thereto and to lower portion of said outer tube.

11. A table-bar of claim 10 wherein said electromechanical means comprises a key-operated lock means mounted adjacent the upper edge of said cylindrical body and electrically connected to said solenoid, said lock means being adapted for activating said outer tube for upward movement.

12. A table-bar of claim 1 wherein said table top wall is movable downwardly from its extended position to its initial position by manual pressure exerted thereon.

13. A table-bar of claim 1 wherein a temperature between about 28° F. and 44° F. is maintained within said refrigerated chamber when said trays are moved upwardly to extended position thereof.

* * * * *

UNITED STATES PATENT AND TRADEMARK OFFICE
CERTIFICATE OF CORRECTION

PATENT NO. : 4,848,091

DATED : July 18, 1989

INVENTOR(S) : Solly Border

It is certified that error appears in the above-identified patent and that said Letters Patent is hereby corrected as shown below:

The title page should be deleted to appear as per attached title page.

Figure 2:
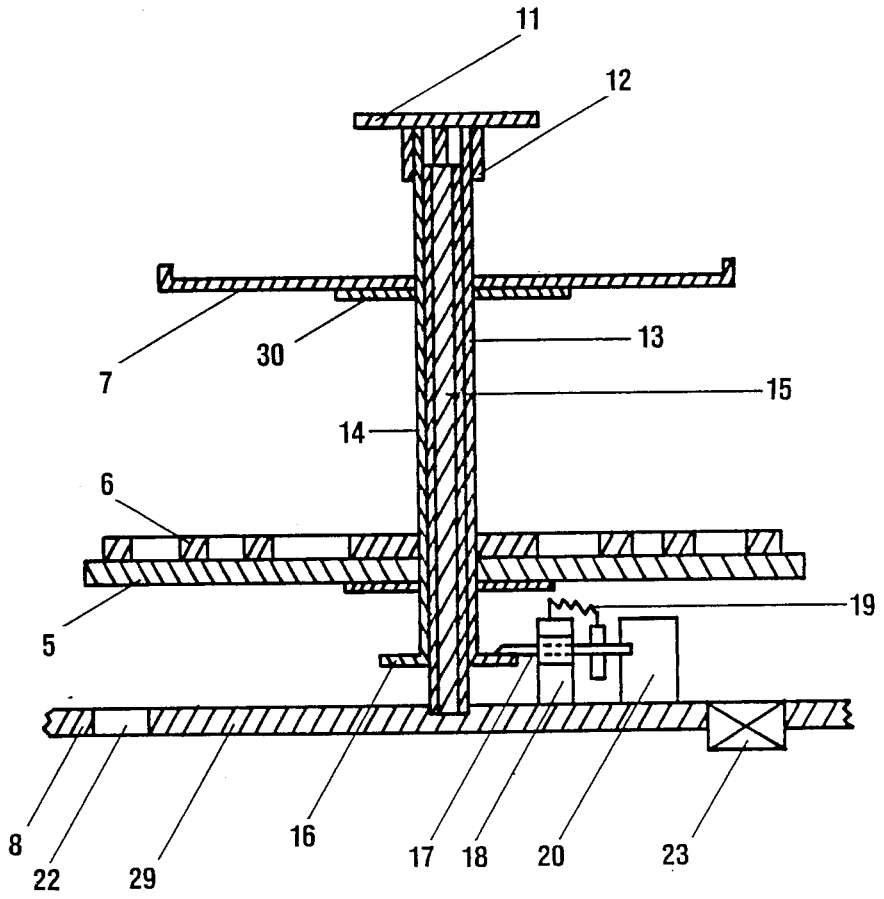
FIG. 2 is a view of the latching mechanism disposed in the base structure.
Figure 3:
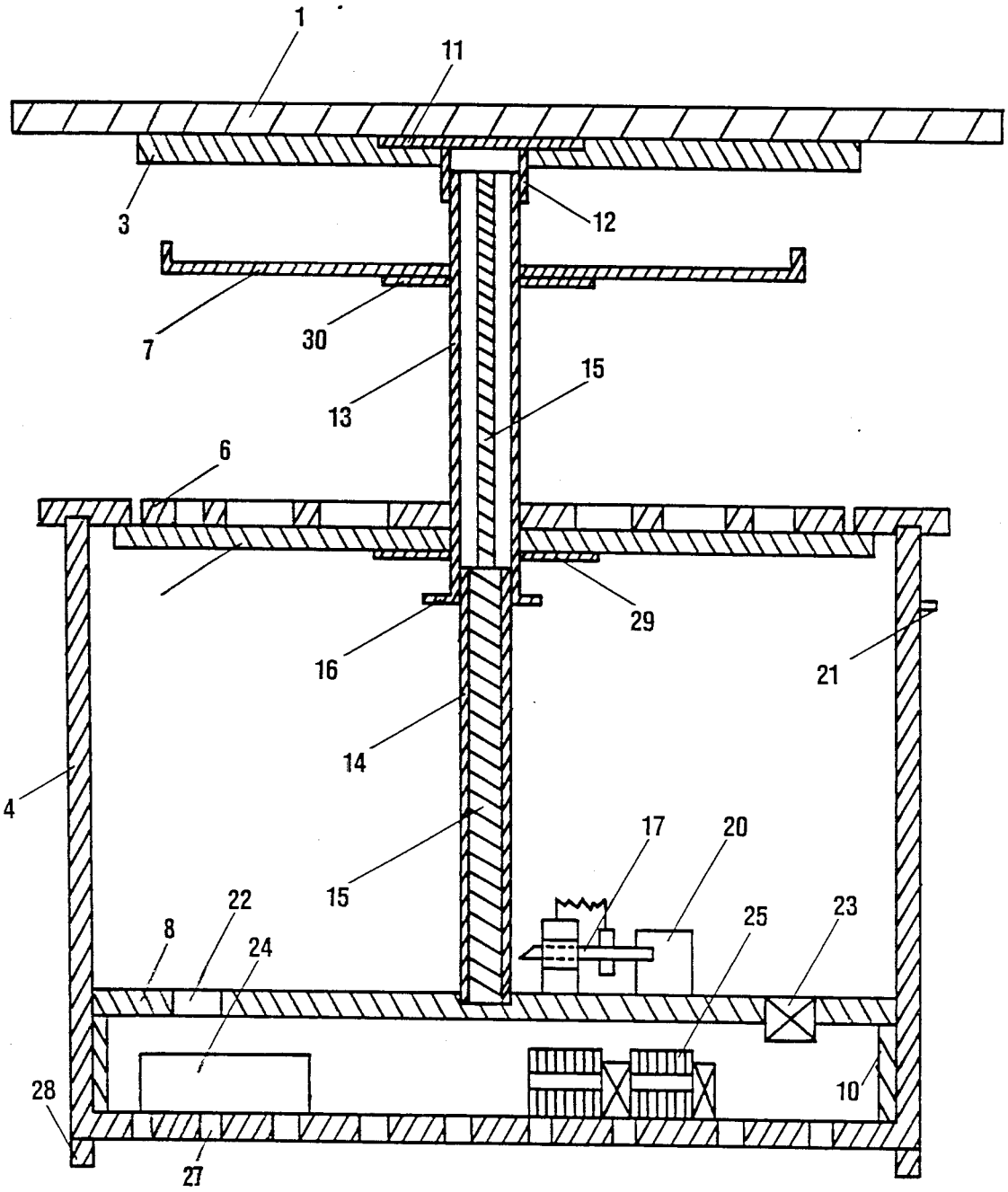
FIG. 3 is a sectional front view of the table-bar in its open position.
Figure 4:
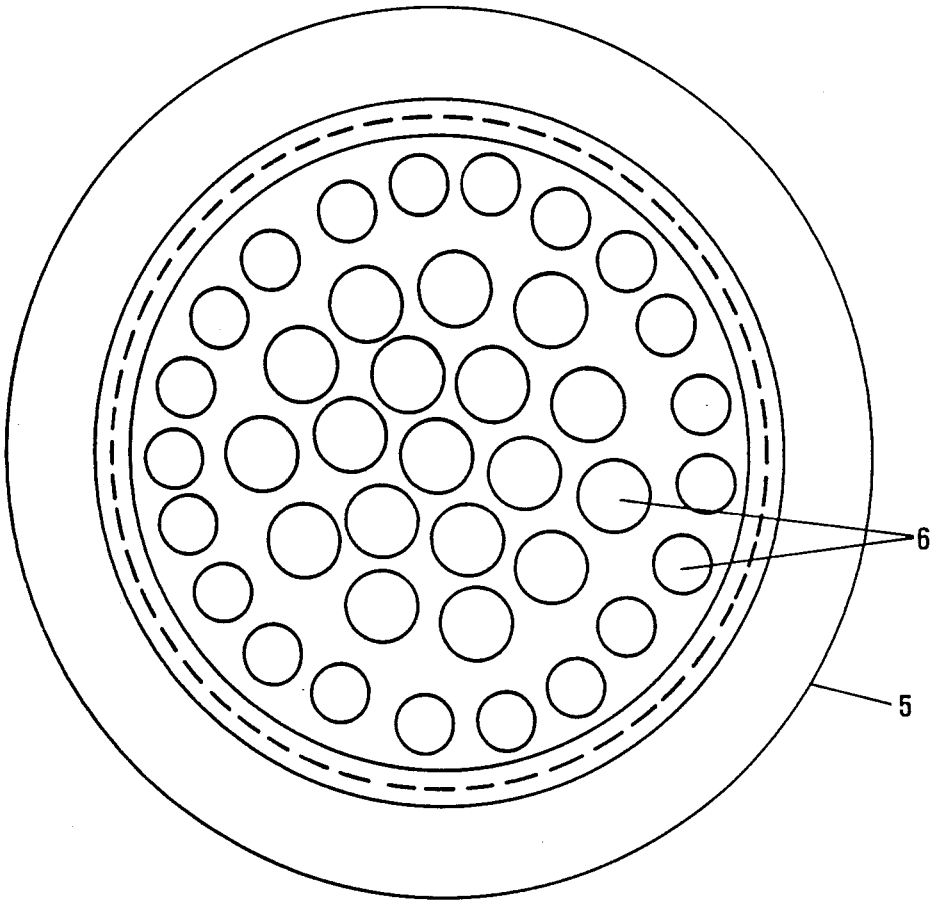
FIG. 4 is a top view of the lower tray showing concave depressions.
Figure 5:
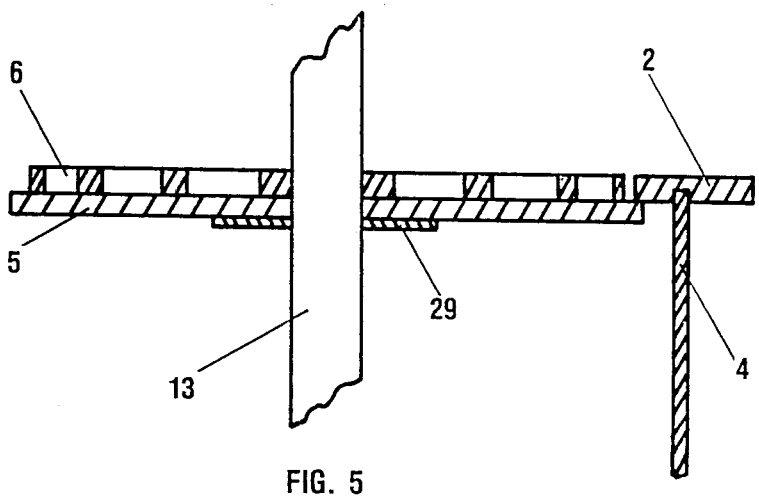
FIG. 5 is a partial sectional front view of the outer tube with the lower tray affixed thereto.
Figure 6:
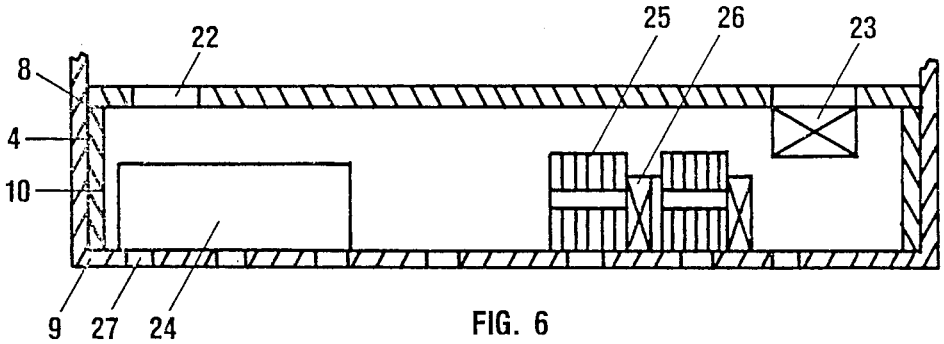
FIG. 6 is a sectional front view of the bottom structure.
Figure 7:
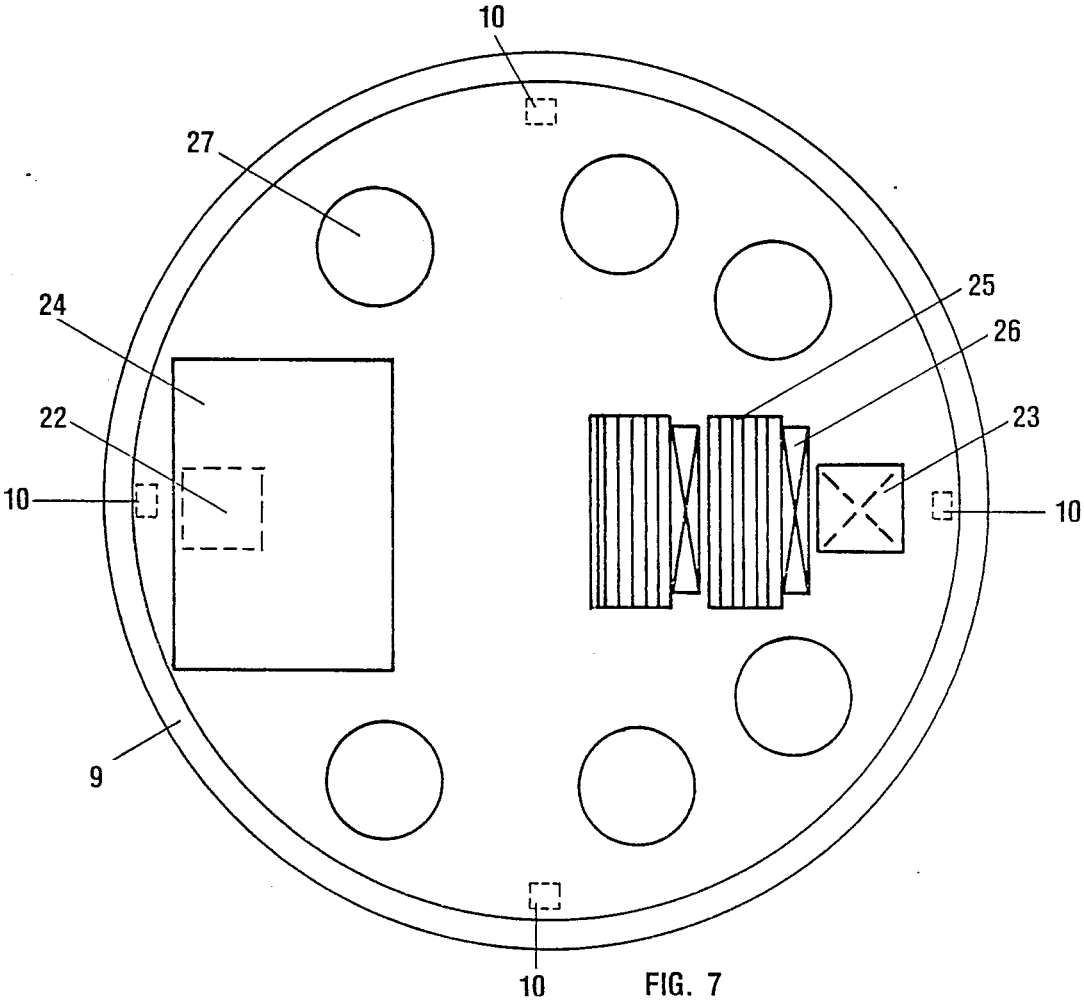
FIG. 7 is a top view of the bottom structure.
Figure 1:
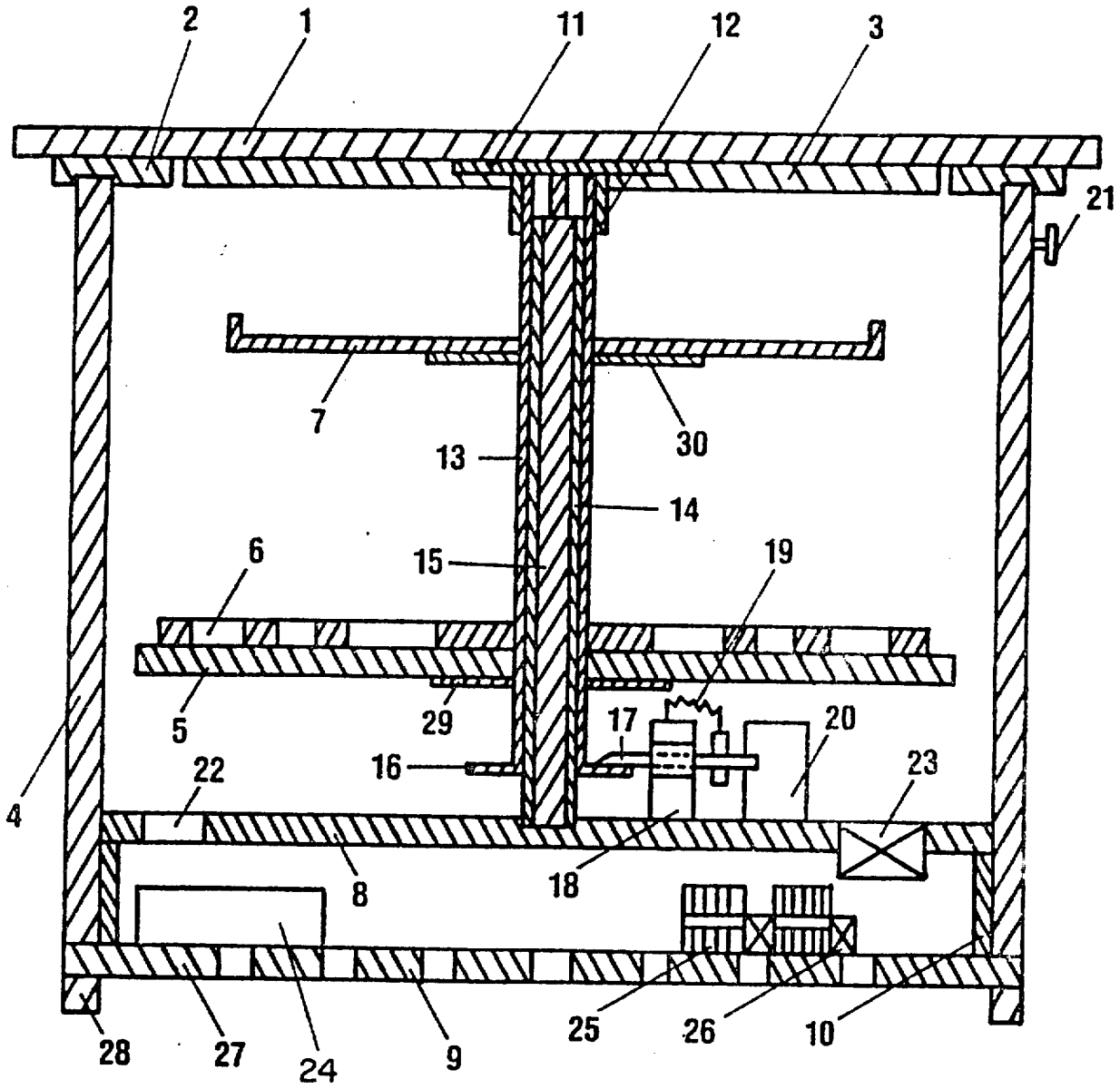
Figure 2:
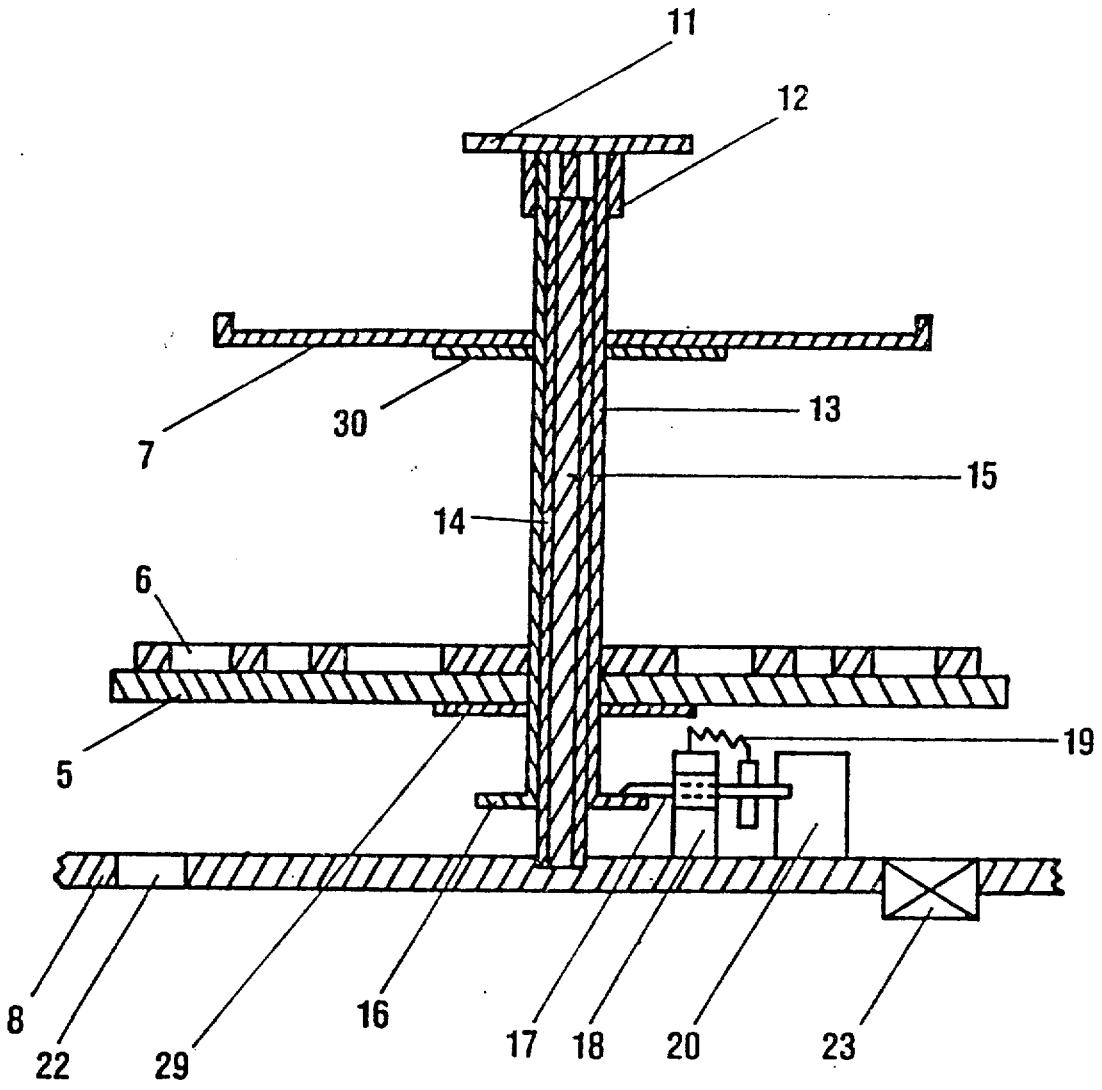
Figure 3:
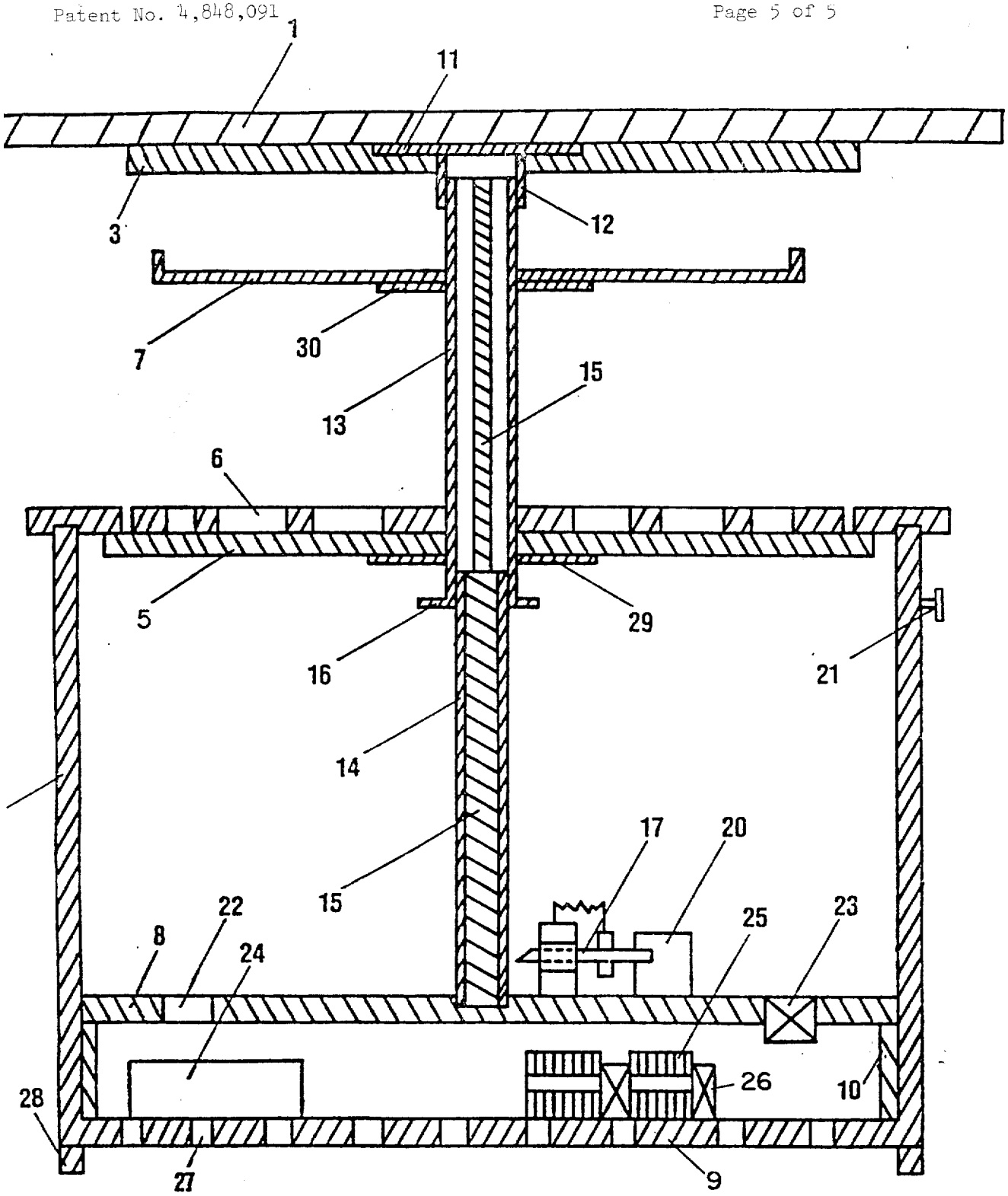

Figures 1, 2 and 3 should appear as shown on the attached sheets.

Claim 13, line 2, "28" should read --38--.

Signed and Sealed this

Second Day of January, 1990

*Attest:*

JEFFREY M. SAMUELS

*Attesting Officer*

*Acting Commissioner of Patents and Trademarks*

United States Patent [19]

Border

[11] Patent Number: 4,848,091

[45] Date of Patent: Jul. 18, 1989

[54] REFRIGERATED TABLE-BAR

[75] Inventor: Solly Border, San Mateo, Calif.

[73] Assignee: Instabar Corporation, Chester, N.Y.

[21] Appl. No.: 144,185

[22] Filed: Jan. 15, 1988

[51] Int. Cl.[4] ..... F25B 21/02

[52] U.S. Cl. ..... 62/3.2; 62/258; 62/458

[58] Field of Search ..... 62/258, 458, 3

[56] References Cited

U.S. PATENT DOCUMENTS

| | | | |
|---|---|---|---|
| 2,093,856 | 9/1937 | Wales | 62/258 |
| 2,895,311 | 7/1959 | Spalvins | 62/458 X |
| 4,400,951 | 8/1983 | Cherry | 62/258 |
| 4,704,870 | 11/1987 | Beitner | 62/258 |

*Primary Examiner*—Lloyd L. King

*Attorney, Agent, or Firm*—T. R. Zegree

[57] ABSTRACT

A portable refrigerated table-bar useful in the hospitality industry comprises an upright cylindrical cabinet having a table top, a centrally disposed dual tube arrangement for raising or lowering slidingly a pair of trays affixed thereto in spaced apart relation and a thermoelectric refrigerating unit disposed within the lower portion of the cabinet. The sliding movement of the trays is activated by electromechanical means associated therewith. One tray is provided with a plurality of depressions for accomodation of beverage bottles.

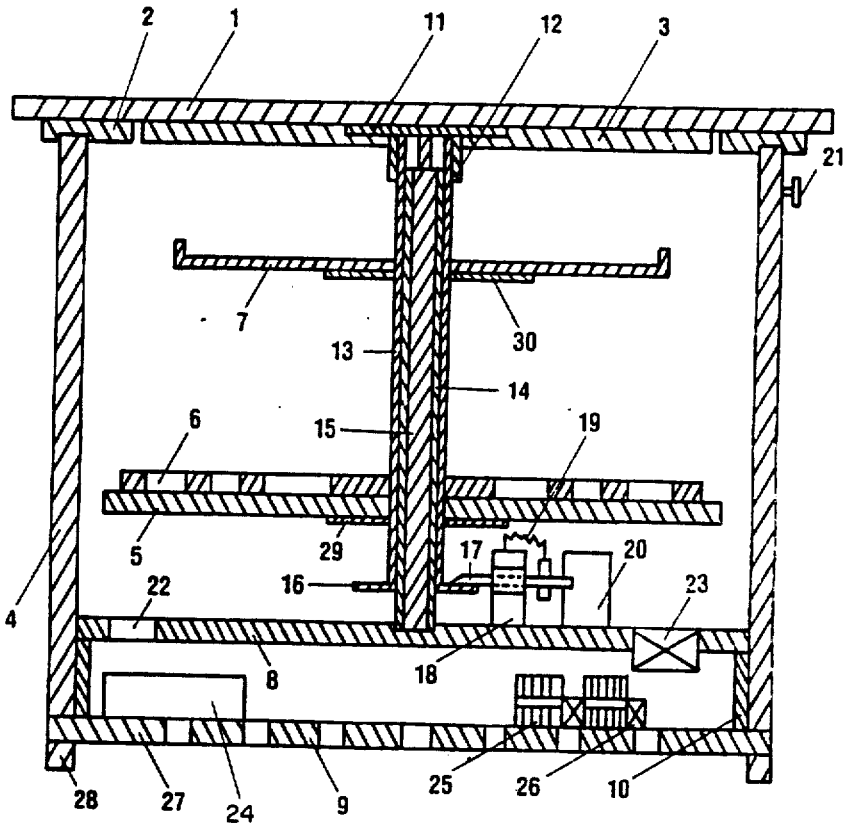

13 Claims, 5 Drawing Sheets